United States Patent [19]

Donald R. Matthews

[11] Patent Number: 5,052,708

[45] Date of Patent: Oct. 1, 1991

[54] SHORT SKI CLIMBER

[76] Inventor: Donald R. Matthews, 2224 Temple View Dr., Provo, Utah 84604

[21] Appl. No.: 510,062

[22] Filed: Apr. 16, 1990

[51] Int. Cl.[5] ..... A63C 5/00

[52] U.S. Cl. ..... 280/604

[58] Field of Search ..... 280/604, 601, 608, 609, 280/809; 248/205.2

[56] References Cited

U.S. PATENT DOCUMENTS

| | | | |
|---|---|---|---|
| 1,989,377 | 1/1935 | Osborn | 280/604 |
| 2,326,802 | 8/1943 | Robinson et al. | 280/604 |
| 3,980,312 | 9/1976 | Buttner | 280/604 X |
| 4,666,178 | 5/1987 | Matthews | 280/604 |

FOREIGN PATENT DOCUMENTS

| | | | |
|---|---|---|---|
| 618159 | 3/1927 | France | 280/604 |

*Primary Examiner*—Andres Kashnikow
*Assistant Examiner*—Michael Mar
*Attorney, Agent, or Firm*—K. S. Cornaby

[57] ABSTRACT

An improved short ski climber that is located in the center of the ski without requiring the owner of the ski to install any kind of permanent hardware on the ski either in front of or behind the climber to which the climber itself is traditionally attached. The skier, therefor, does not have to drill holes or insert screws or similar devices into the finish of the skis.

This ski climber is much smaller and lighter than the traditional types of short climbers described, and can be attached or removed from a ski in much less time. This is a major factor in racing and in extended treks over days or weeks when a climber may be attached or removed from skis dozens of times in a day depending on conditions.

3 Claims, 2 Drawing Sheets

SHORT SKI CLIMBER

DESCRIPTION OF PRIOR ART

Ski climbers, climbing skins, or "skins" as they are variously known, have been in use for centuries, and their method of construction and use has been well known for many years. The belly portions of hides from sea animals such as seals were commonly used because during the brief periods of time in which these animals traveled on ice, snow, or land, they slithered on their bellies causing the hair to grow flat in one direction. This unidirectional fur was cut in strips the width of a ski with the fur lying to the rear, and the pieces were sewn end to end and fastened to the under side of skis. This allowed the skier to move forward but not backward thus enabling him to climb very steep slopes without having to herring bone or side step while still enabling him to glide forward down hill or on level terrain.

During World War II thousands of mountain combat troops from Norway, Finland, Italy, and the United States' 10th Mountain Division were known to have used full length ski climbers extensively. The construction of the climbers used by U.S. forces was known to have been mohair slant pile woven into a fabric backing which in most cases was treated with a latex or plastic solution. The climber was then strapped to the ski. Variations of this approach using nylon slant pile fabric are still in use by the Army today. The commercial ski industry glues ski climber fabric to the ski or uses various mechanical attachment systems.

While there have been many innovations in these full length ski climber applications, very little progress has been made with short ski climbers which are the subject of this application.

An attempt is known to have been made in the development of short climbers by 3M ® Corporation when they marketed their unidirectional material called Fibertran ®. This product was sold in consumer kits. The consumer would route a two or three foot narrow groove out of the bottom of his ski in the center portion to accept a piece of Fibertran ® which was permanently glued in place. The system worked well in the climbing mode, and on undulating terrain where there was need for alternate climbing and gliding. But in all other kinds of skiing where the skier did not want to be restricted by the ski climber there was no way to remove the permanently-inletted Fibertran ® strips. Accordingly the product was removed from the market and the problem of developing a satisfactory short climber remained unresolved.

Racers have been known to use short strips of ski climber fabric glued to the center of their skis to gain an uphill advantage (while the climber remained glued in place). However, it is generally a matter of only a few minutes before the glue fails and the climber falls off because there is no other attachment system.

To my knowledge there is no other known system whereby a short climber is attached to the center of a ski except where hardware is permanently attached to the ski in front of and behind the short climber to which the climber is then attached FIG. 1.

Some companies make permanently-attached climber systems FIG 1. However, many skiers do not want to damage their skis with this kind of permanently-attached hardware (screws, etc., are used) and so the problem of a viable short climbing skin has remained unsolved.

DETAILED DESCRIPTION

Figure 1:
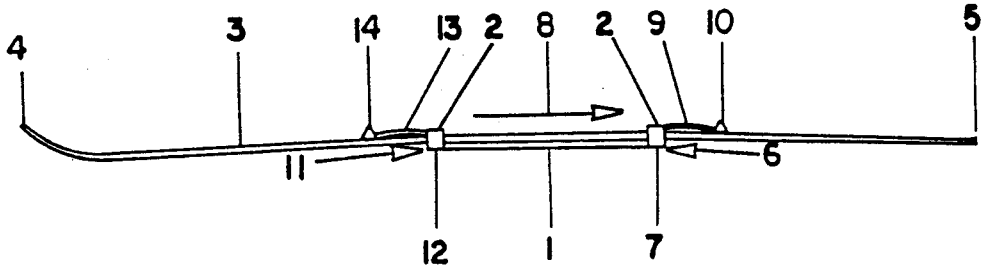
FIG. 1 PRIOR ART
FIG. 1 is a side view of a current ski climber attached to a ski.

This invention is an improvement over known art and can be best understood by describing current art as shown in FIG. 1 wherein a short ski climber 1 with straps 2 is located under the center (longitudinally) of the ski 3 midway between the tip 4 of the ski 3 and the tail 5 of the ski 3. When the skier is in the uphill mode (climbing a hill) there are strong loads 6 against the tail 7 of the ski climber 1 because of the combined weight of the skier and his skis 8 being pulled by gravity down the hill. As a result of these loads 6 on the tail 7 of the ski climber 1, the ski climber 1 will slide toward the tip 4 of the ski 3 rendering it useless as a ski climbing device.

Currently in the ski industry, the only way known to overcome this tendency for the ski climber 1 to move forward toward the tip 4 of the ski 3 in the uphill mode is to attach a tail harness 9 to the tail 7 of the ski climber 1 and to attach the tail harness 9 to a tail fixture 10 that is permanently attached to the ski 3, with screws or similar devices thus permanently marring the ski and requiring the tail fixture 10 to always be attached to the ski 3 whether in use or not during other modes of skiing.

This entire process is reversed when the skier is in the downhill mode (descending a hill) wherein there are strong loads 11 against the tip 12 of the ski climber 1 that will slide the ski climber 1 toward the tail 5 of the ski 3 rendering it useless for either gliding or braking. Currently in the ski industry the only known way to overcome this problem is to again attach a tip harness 13 to the tip 12 of the ski climber 1 and to attach the tip harness 13 to a tip fixture 14 that is permanently attached to the ski 3 with screws or similar devices thus permanently marring the ski and again, requiring the tip fixture 14 to always be attached to the ski 3.

Figure 2:
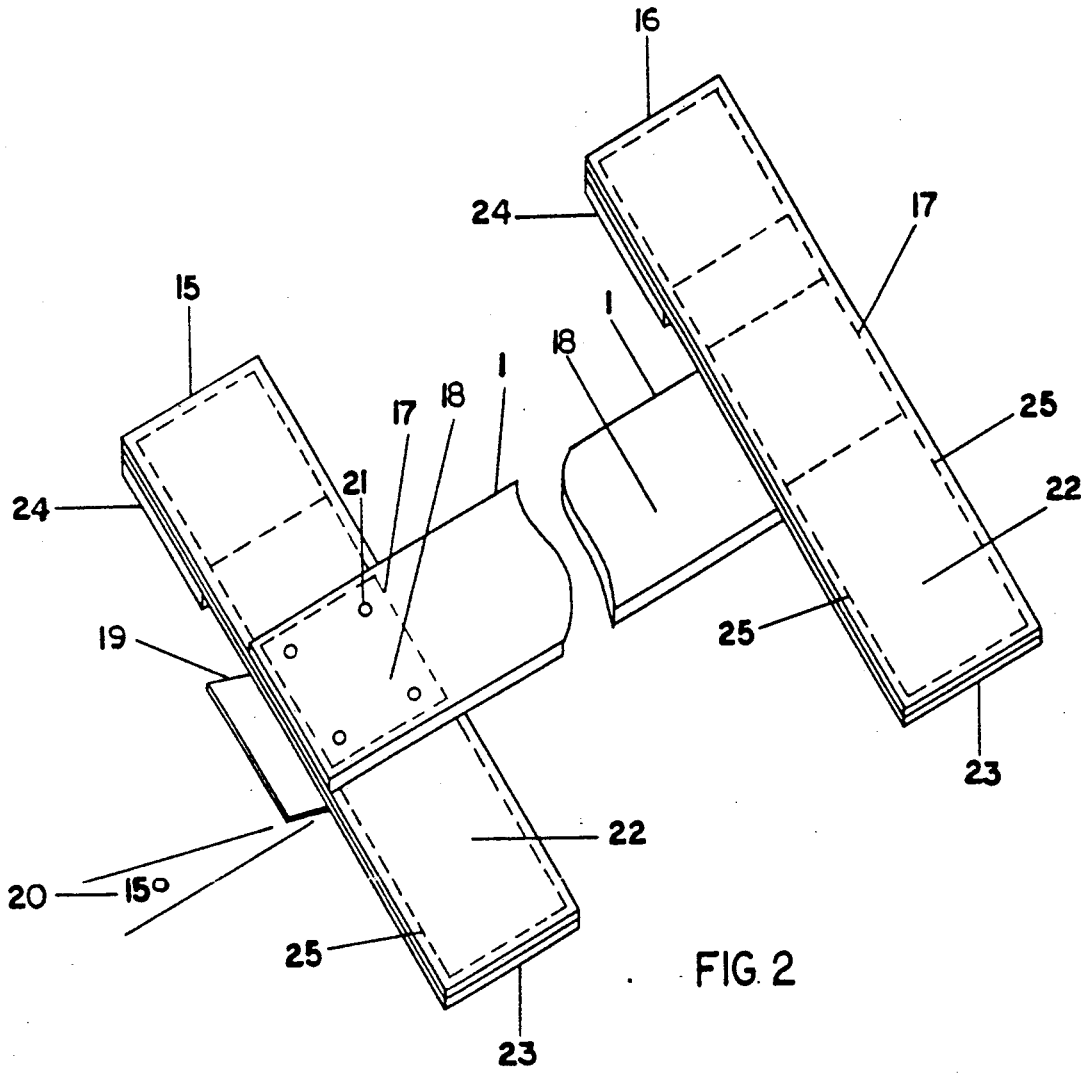
FIG. 2 is a perspective view of the entire assembled ski climber.

In the first embodiment of this invention shown in FIG. 2 a forward strap 15 and a rear strap 16 are sewn 17 to the climber 1 (a piece of slant pile fabric) with the adhesive side 18 up and a metal clip 19 with a 15-degree bend 20 in it is fastened to the forward part of the ski climber 1 with four rivets 21.

The construction of the forward strap 15 and the rear strap 16 is a sandwich made from a piece of loop material 22 (from a mushroom and loop fastening system), a piece of webbing 23, and a short piece of mushroom 24 all sewn 25 together. There is no difference between the construction of the forward strap 15 and the rear strap 16. However, the forward strap 15 is sewn under the ski climber 1 (slant pile fabric) and the rear strap 16 is sewn on top of the ski climber (slant pile fabric).

Figure 3:
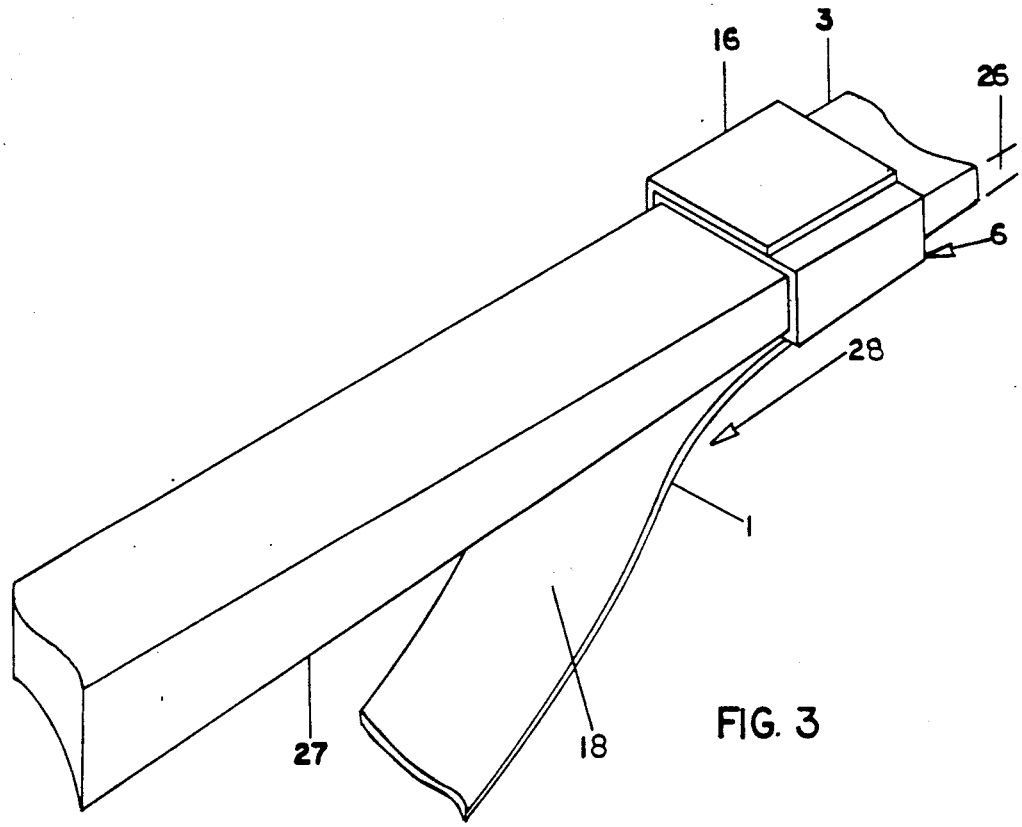
FIG. 3 is a perspective view of the rear strap closure during attachment to the ski.

In FIG. 3 the rear strap 16 is shown closed around the rear portion of the ski 3 where the ski 3 is thin 26 in profile and in cross section. Inasmuch as the adhesive side 18 of the ski climber 1 is not in contact with the bottom side of the ski 27, the rear strap 16 is then slid forward 28 until it stops because the increasing thickness of the ski will not allow it to go any further. The adhesive 18 side of the full length of the ski climber 1 is then attached to the bottom side of the ski 27 and the forward strap 15 (FIG. 2 & 4) is closed.

Because all potential forward movement 28 of the ski climber 1 has now taken place, any loading 6 on the tail of the ski climber 1 while in the climbing or uphill mode will cause no additional forward movement 28 of the ski climber 1.

Figure 4:
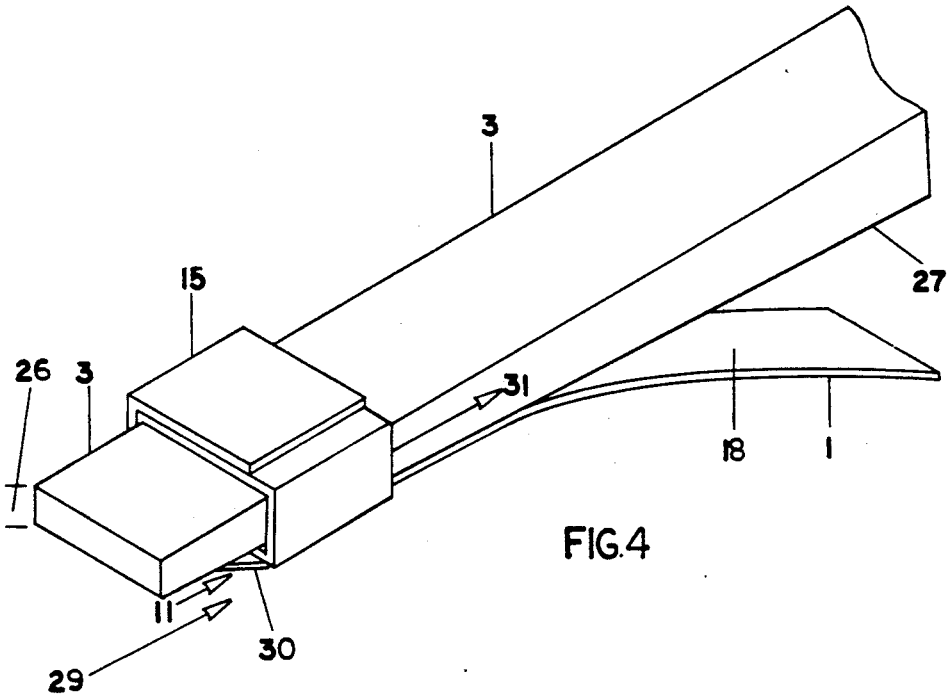
FIG. 4 is a perspective view of the forward strap closure and metal clip during attachment to the ski.

FIG. 4 illustrates how in the downhill mode the snow bypasses 29 the angled portion of the metal clip 30 because the angled portion of the metal clip 30 is pressed against the bottom side of the ski 27 providing a smooth low angle surface for bypass of the snow 29.

The result is that there is minimal loading 11 on the front of the angled portion of the metal clip 30 that would tend to move the ski climber 1 to the rear 31 of the ski 3 in the downhill mode. Extra insurance is provided against such movement by the fact that the adhesive side 18 of the ski climber 1 that is under the forward strap 15 is in contact with the bottom side of the ski 27. In addition the adhesive side 18 of the ski climber 1 is pressed into this position (and is held firmly) by the closure of the forward strap 15. Because the forward strap 15 is on the forward part of the ski 3 where the ski is thin in profile and in cross section 26, any movement of the ski climber 1 to the rear 31 is also resisted by the increasing thickness of the ski 3 toward its rear. The forward strap 15 is closed tightly and because its mushroom and loop closure is absolute (allowing no slack), movement of the forward strap 15 to the rear 31 is further disallowed.

A mushroom and loop fastening system, which is a nonproprietary product made mostly in three European countries and which is little known in the U.S., is specified for this application because it provides a positive closure with absolutely no shear movement whatsoever once it is closed. Mushroom and loop has up to approximately ten times the shear strength of typical hook and loop systems. For this reason it is the only fastening system of this type that can withstand the enormous loads created on the closure of the rear strap 16 (FIG. 3) when the rear strap 16 (FIG. 3) is moved forward 28 against the increasing thickness of the ski 3 during installation on the ski 3 as described in FIG. 3. Conversely, commonly available hook and loop systems are totally incapable of resisting these loads and, therefore, are not an alternative choice.

In fact I know of no other alternatives to the mushroom and loop fastening system. While snaps, buckles, hooks and levers all have the required strength they allow too much travel from one position or adjustment to the next which translates into large and unacceptable forward movement 28 (FIG. 3) of the rear strap 16 (FIG 3) when the ski climber 1 is attached to the ski 3. Turnbuckles with over-center devices provide the necessary fine adjustment but are too long for this application when used on narrow 44mm skis.

What is claimed is:

1. A process for providing a ski with a climber skin, the ski being of the type having a lower running surface and a tail section with a profile and cross section which is thinner than that of a central section of the ski, the process comprising the steps of:

providing an elongate climber skin having a lower snow engaging surface for frictionally engaging the snow when moved in one direction while sliding over the snow when moved in an opposite direction, forward and rearward straps secured to forward and rearward ends respectively of said climber skin, a metal plate secured to said forward strap, and an adhesive covering a portion of an upper surface of said climber skin, each of said forward and rearward straps having a pair of free end portions with mushroom and loop fasteners secured to respective ones of each pair of said free end portions;

securing the end portions of said rearward strap in a tight manner around the tail section of said ski with the upper surface of said climber skin facing the running surface of the ski;

pulling the climber skin in a forwardly direction while holding the adhesive covered portion of the climber skin away from the running surface of the ski;

pressing the adhesive covered portion of the climber skin against the running surface of the ski for adhering the climber skin to the running surface; and securing the end portions of said forward strap in a tight manner around the central section of the ski with said metal plate extending forwardly and upwardly from said forward strap, a forward edge of said metal plate being pressed tightly into engagement with said running surface.

2. A process as set forth in claim 1, wherein the rearward strap is adapted to a portion of be secured to the tail section of the ski having the narrowest width.

3. A process as set forth in claim 1, wherein a rearward portion of the climber skin adjacent the rearward strap has no adhesive on said upper surface of the skin.

* * * * *